US012442206B2

(12) United States Patent
Lange

(10) Patent No.: US 12,442,206 B2
(45) Date of Patent: Oct. 14, 2025

(54) AUTOMATED BUILDING WASHING APPARATUS

(71) Applicant: Michael R. Lange, Little Canada, MN (US)

(72) Inventor: Michael R. Lange, Little Canada, MN (US)

( * ) Notice: Subject to any disclaimer, the term of this patent is extended or adjusted under 35 U.S.C. 154(b) by 406 days.

(21) Appl. No.: 17/899,600

(22) Filed: Aug. 30, 2022

(65) Prior Publication Data

US 2023/0067008 A1 Mar. 2, 2023

Related U.S. Application Data

(60) Provisional application No. 63/239,236, filed on Aug. 31, 2021.

(51) Int. Cl.

| | |
|---|---|
| ***E04G 23/00*** | (2006.01) |
| ***A47L 1/02*** | (2006.01) |
| ***A47L 3/02*** | (2006.01) |
| ***E04G 3/30*** | (2006.01) |
| *E04G 5/14* | (2006.01) |

(52) U.S. Cl.
CPC ..... *E04G 23/002* (2013.01); *A47L 1/02* (2013.01); *A47L 3/02* (2013.01); *E04G 3/30* (2013.01); *E04G 5/14* (2013.01)

(58) Field of Classification Search
CPC ..... E04G 23/002
See application file for complete search history.

(56) References Cited

U.S. PATENT DOCUMENTS

2018/0055299 A1* 3/2018 Blake ..... B08B 3/04

* cited by examiner

*Primary Examiner* — Jason Y Ko
(74) *Attorney, Agent, or Firm* — Skaar Ulbrich Macari, P.A.

(57) ABSTRACT

An automated building washing device generally includes a spray bar assembly coupled to a window washing swing stage. The spray bar assembly is horizontally movable from end-to-end along the longitudinal direction of a window washing swing stage while spray heads rotate so that a relatively large portion of building surface can be quickly cleaned. The spray bar assembly includes a hollow rotating bar and spray heads inside of a shroud so that the bar can rotate as water or cleaning solution is sprayed onto the building surface for cleaning.

19 Claims, 8 Drawing Sheets

AUTOMATED BUILDING WASHING APPARATUS

PRIORITY

This application claims the benefit of U.S. Provisional Application Ser. No. 63/239,236, filed on Aug. 31, 2021, which is hereby incorporated herein by reference in its entirety.

FIELD

The present invention relates generally to window washing devices and, more particularly, to automated washing devices for exterior surfaces of buildings.

BACKGROUND

Building structures, particularly tall urban buildings, were typically washed manually. In manual washing, a scaffolding structure (e.g., MHB-60 and MHB-80 models from Altrex, Sky Stage Ultra from Skyclimber, etc.) would be suspended from the top of the building to be washed. The scaffolding can be raised or lowered so that a person standing on the scaffolding can wash the windows and exterior surfaces of the building by hand. After a vertical section of the building is washed, the scaffolding is repositioned laterally so that the next adjacent vertical section of the building may be cleaned. This procedure was repeated until the entire building has been washed. This and other methods of manually cleaning windows of a building have proven to be extremely time consuming and labor intensive.

Manual washing of buildings is also unacceptably dangerous. Equipment can fail. Operators can misuse the equipment. And environmental conditions, such as wind and precipitation can make the cleaning operations more dangerous or even impossible. Thus, insurance rates for manual building cleaning businesses can comprise a significant portion (e.g. 40%) of labor costs.

Various types of automated window washing devices have been developed. For example, U.S. Pat. No. 7,665,173 discloses one such automated window washing device. The entirety of U.S. Pat. No. 7,665,173 is hereby incorporated herein by reference. The device shown in this patent is relatively large and heavy. This means that the apparatus must be transported in a large commercial size vehicle and there must be a team of operators to operate the device from remote positions. It also requires specialized rigging capable of lifting at least 2000 pounds. Thus it is best suited only for use on very large buildings such as skyscrapers. The power requirements of such large devices are also significant, which requires a dedicated power cable (typically 220V) to be connected the device.

Attempts have been made to adapt an automated washing apparatus to conventional swing stage scaffolding, which already exists on most buildings so that manual washing of the sides of the building can be performed, as indicated in US Published Patent Application Nos. US20180055298A1 and US20180055299A1. However, such configuration has limited articulation of the brush, which limits cleaning speed because it requires a drop every 8-10 feet of building height, and a live operator is required to operate the washing device from the swing stage.

U.S. Pat. No. 11,408,190 discloses a horizontally movable brush system. U.S. Pat. No. 11,408,190 is hereby incorporated herein by reference in its entirety. However, in some instances, a brush-based system is not optimal because, for example, the building's exterior architecture makes cleaning difficult because of the inability to maintain consistent contact by the brush.

Therefore, there is an ongoing need to provide an automated cleaning device, system, and method that can be adapted to existing swing stage scaffolding that improves upon at least some of the drawbacks of the conventional technology.

SUMMARY

The present invention addresses the above-noted concerns regarding conventional building washing methods and automated machinery for the same.

In certain examples, an automated building washing apparatus can include a swing stage, a track coupled to the swing stage, and a spray bar assembly. The track is movable in a horizontal axis along the swing stage parallel to a surface to be washed. The spray bar assembly is coupled to the track such that the spray bar assembly can move along the horizontal axis across the surface to be washed. The spray bar assembly includes a circular shroud defining an enclosure with an open side that faces the surface to be washed, a hollow bar rotationally disposed about its midpoint inside of the circular shroud, a first spray head disposed at a first end of the hollow bar, and a second spray head disposed at a second end of the spray bar. The hollow bar rotates about an axis that is perpendicular to a direction that the track moves. The first and second spray heads are configured to spray a cleaning solution or water towards the surface to be washed.

In a further example, an automated building washing assembly can be retrofitted to a swing stage. The automated building washing assembly can include a track that can be coupled to the swing stage and a spray bar assembly coupled to the track such that the spray bar assembly can move horizontally between opposing longitudinal ends of the track. The spray bar assembly can include a circular shroud defining an enclosure with an open side that faces outward from the swing stage and towards a surface to be washed, a hollow bar rotationally disposed about its midpoint inside of the circular shroud, a first spray head disposed at a first end of the hollow bar, and a second spray head disposed at a second end of the spray bar. The hollow bar rotates about an axis that is perpendicular to a direction that the spray bar assembly moves along the track. The first and second spray heads are configured to spray a cleaning solution or water towards the surface to be washed.

The first and second spray heads can be recessed within the shroud such that they do not protrude outward from the open side and contact the surface to be washed.

The shroud can be located between the swing stage and the surface to be washed.

A control box can be disposed on the swing stage. The control box includes control electronics for controlling operation of the track. The control electronics can be configured to increase a speed that the track moves the spray bar assembly when a speed that the swing stage is ascending or descending the surface to be washed is increased. The control electronics can be configured to increase a rotational speed of the hollow bar when a speed that the swing stage is ascending or descending the surface to be washed is increased.

The swing stage can include a first longitudinal side to face a building surface to be cleaned and a second longitudinal side, opposite the first longitudinal side, that faces away from the building surface to be cleaned. The automated building washing apparatus can further include a counterforce means to move or hold the spray bar assembly adjacent to the surface to be washed. The counterforce means can be a fan.

The swing stage can define a deck that is sized to allow an adult human to walk between opposing longitudinal ends of the swing stage. The spray bar assembly is located such that the spray bar assembly does not impede the adult human from walking between opposing longitudinal ends of the swing stage when the spray bar assembly is moved along the track.

A gyroscopic stabilizer can be provided to the swing stage.

A block stop can be provided to the swing stage and configured to be secured to a stabilization cable.

In yet another example, a method of washing a building can include attaching a track to a swing stage, coupling a spray bar assembly to the track, rotating a hollow bar and a pair of spray heads about an axis normal to a surface of the building to be washed while linearly moving the spray bar assembly between longitudinal ends of the swing stage, and changing a vertical height of a swing stage while linearly moving the spray bar assembly between longitudinal ends of the swing stage.

The above summary is not intended to limit the scope of the invention, or describe each embodiment, aspect, implementation, feature or advantage of the invention. The detailed technology and preferred embodiments for the subject invention are described in the following paragraphs accompanying the appended drawings for people skilled in this field to well appreciate the features of the claimed invention. It is understood that the features mentioned hereinbefore and those to be commented on hereinafter may be used not only in the specified combinations, but also in other combinations or in isolation, without departing from the scope of the present invention.

Figure 1:
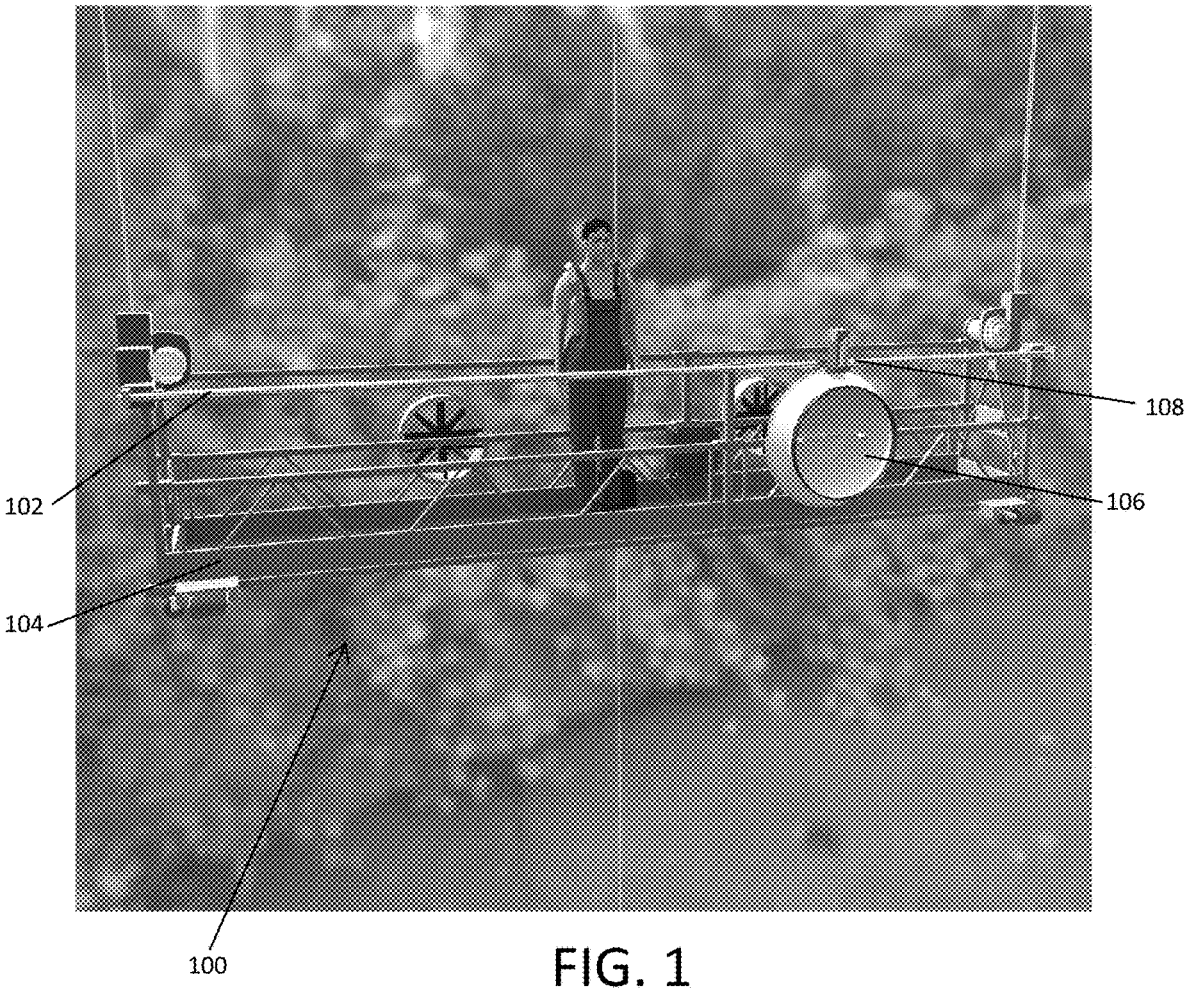
FIG. 1 is a perspective view of an automated building cleaning device in accordance with certain example embodiments.

While the invention is amenable to various modifications and alternative forms, specifics thereof have been shown by way of example in the drawings and will be described in detail. It should be understood, however, that the intention is not to limit the invention to the particular example embodiments described. On the contrary, the invention is to cover all modifications, equivalents, and alternatives falling within the scope of the invention as defined by the appended claims.

DETAILED DESCRIPTION

In the following descriptions, the present invention will be explained with reference to various example embodiments; nevertheless, these embodiments are not intended to limit the present invention to any specific example, environment, application, or particular implementation described herein. Therefore, descriptions of these example embodiments are only provided for purpose of illustration rather than to limit the present invention.

Referring to FIGS. 1-7, various views of an automated washing device 100 are shown. The washing device 100 generally comprises a frame 102 that can be in the form of a suspended bucket, scaffolding or swing stage 104 (hereinafter inclusively described as swing stage). One or more washing spray bar assemblies 106 are coupled to the swing stage 104 via a track 108 that is secured to the swing stage 104. Each spray bar assembly 106 is coupled such that the spray bar rotates about an axis normal (perpendicular) to the vertical axis, which is typically normal or perpendicular to the surface of the building being washed.

The spray bar assembly is mounted to a sliding track 108 so that the spray bar assembly can slide linearly side-to-side along the swing stage 104 in the horizontal plane. Such movement is along the longitudinal axis of the swing stage 104 and parallel to the exterior surface of the building that is being cleaned.

The track 108 and spray bar assembly 106 can be retrofitted to existing swing stages, lifts, boom trucks and other structures with mounting brackets. For example, the track 108 is secured with fasteners to the top and bottom railings of the building side structural members of the swing stage.

More than one spray bar assembly 106 can be provided along the track 108 in the same horizontal plane, and/or a second, third, etc. spray bar assembly 106 can be mounted vertically above and/or below the spray bar assembly 106 depicted in FIGS. 1-7. The spray bar assembly 106 can also be used simultaneously with a rotating brush assembly, such as disclosed in U.S. Pat. No. 11,408,190, in additional embodiments.

The spray bar assembly 106 comprises a hollow bar 110 that is rotational disposed about its midpoint inside of a circular shroud 112. The shroud 112 has an open side facing towards the building surface to be cleaned (away from the swing stage 104), but is otherwise enclosed. The opposing ends of the hollow bar 110 are provided with spray heads 114. The hollow bar 110 and spray heads are sized and configured to be recessed within the shroud so that they do not protrude outward from the open side of the shroud 112 and contact the surface being cleaned.

Figure 2:
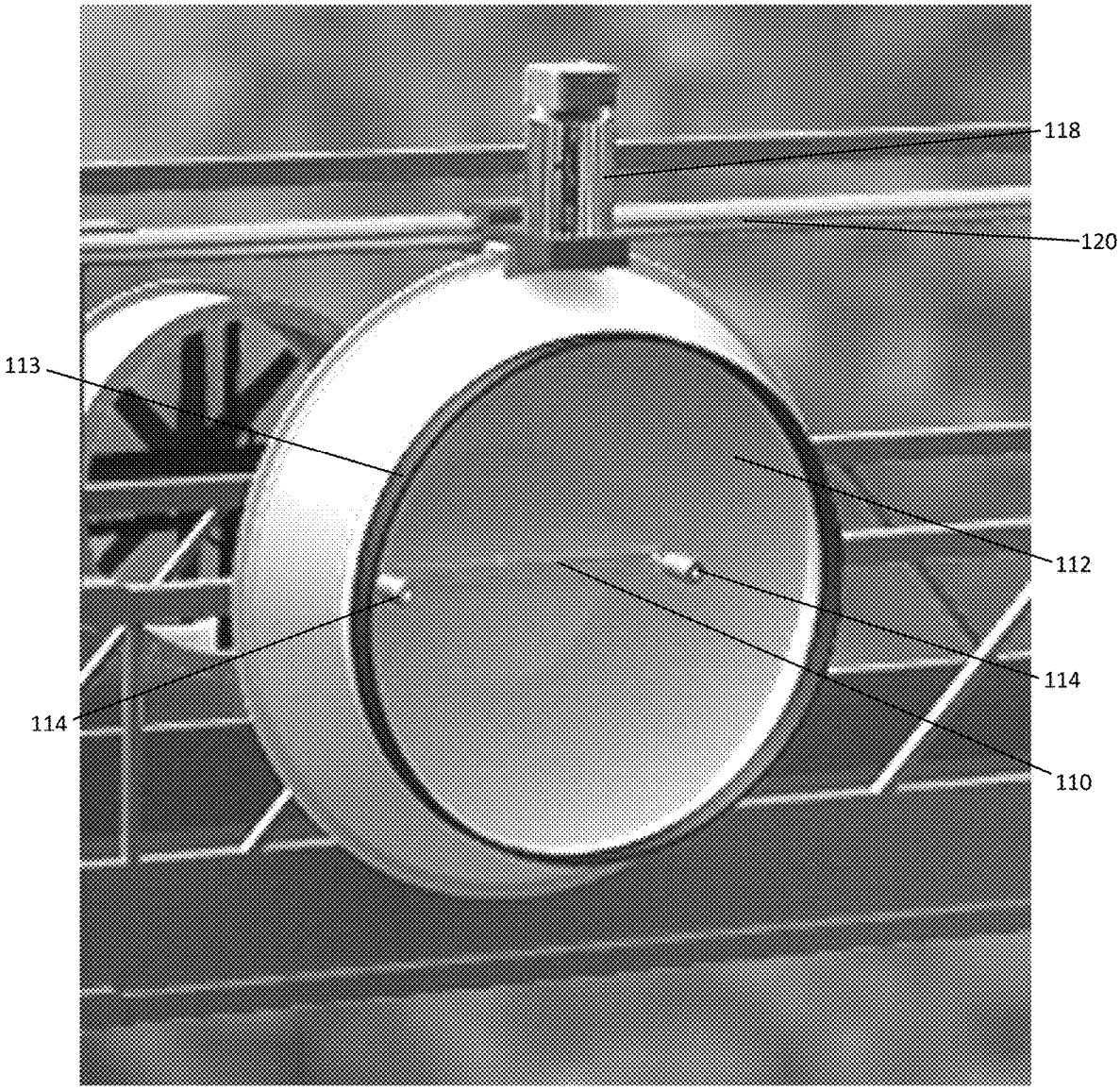
FIG. 2 is another perspective view of an automated building cleaning device in accordance with certain example embodiments.
Figure 3:
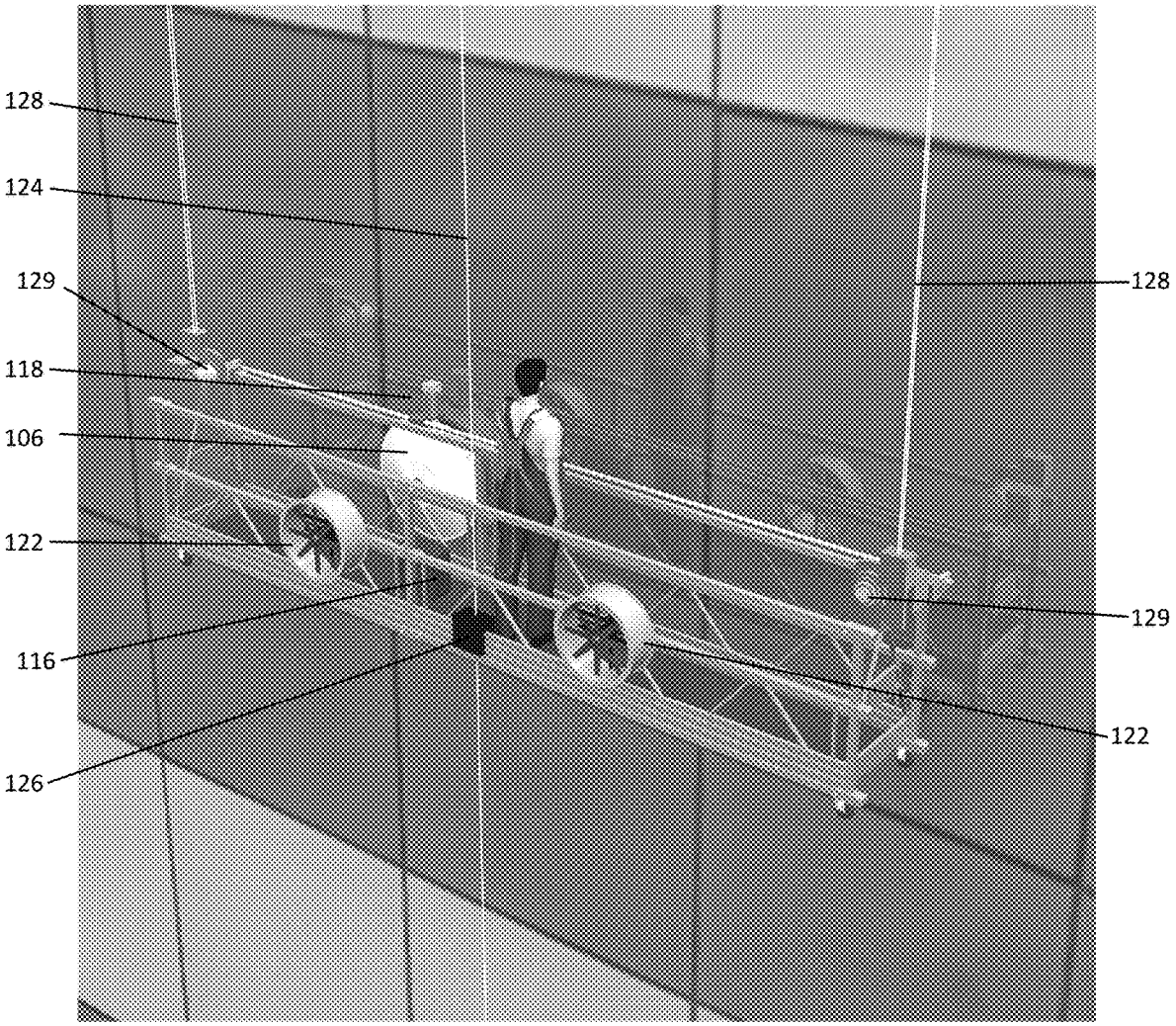
FIG. 3 is a perspective view of an automated building cleaning device shown against an exterior surface of a building in accordance with certain example embodiments.
Figure 4:
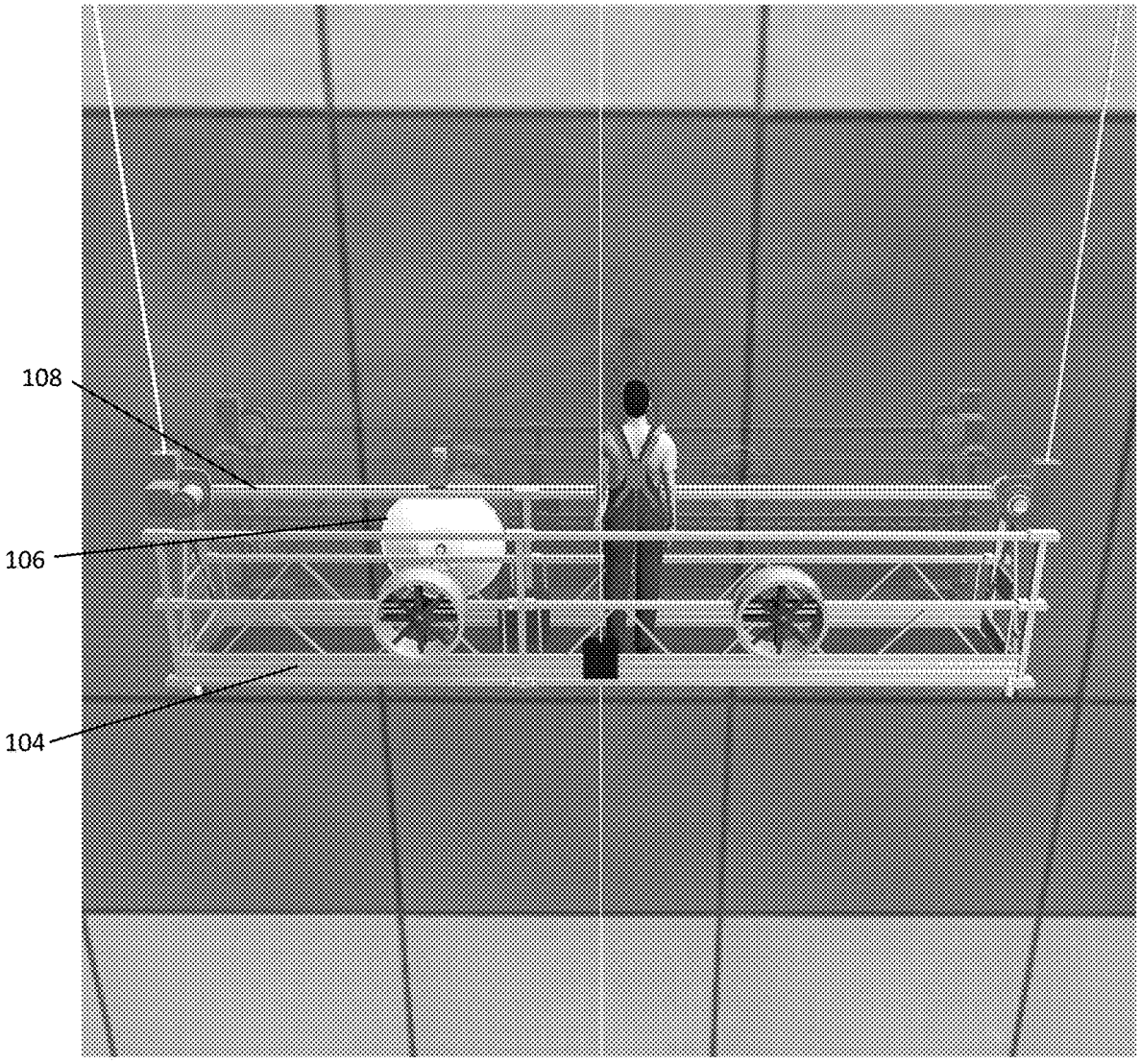
FIG. 4 is another perspective view of an automated building cleaning device shown against an exterior surface of a building in accordance with certain example embodiments.
Figure 5:
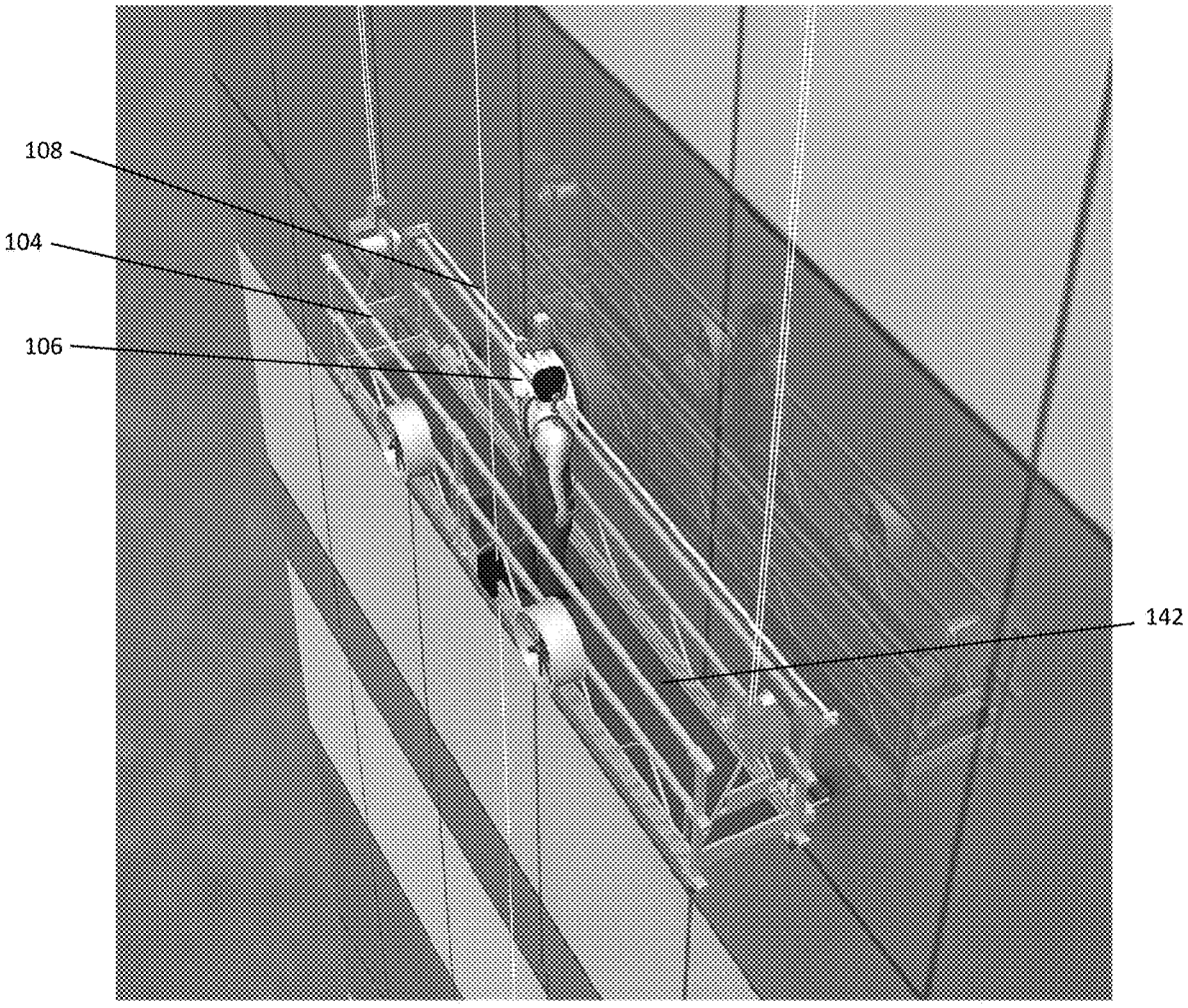
FIG. 5 is another perspective view of an automated building cleaning device shown against an exterior surface of a building in accordance with certain example embodiments.
Figure 6:
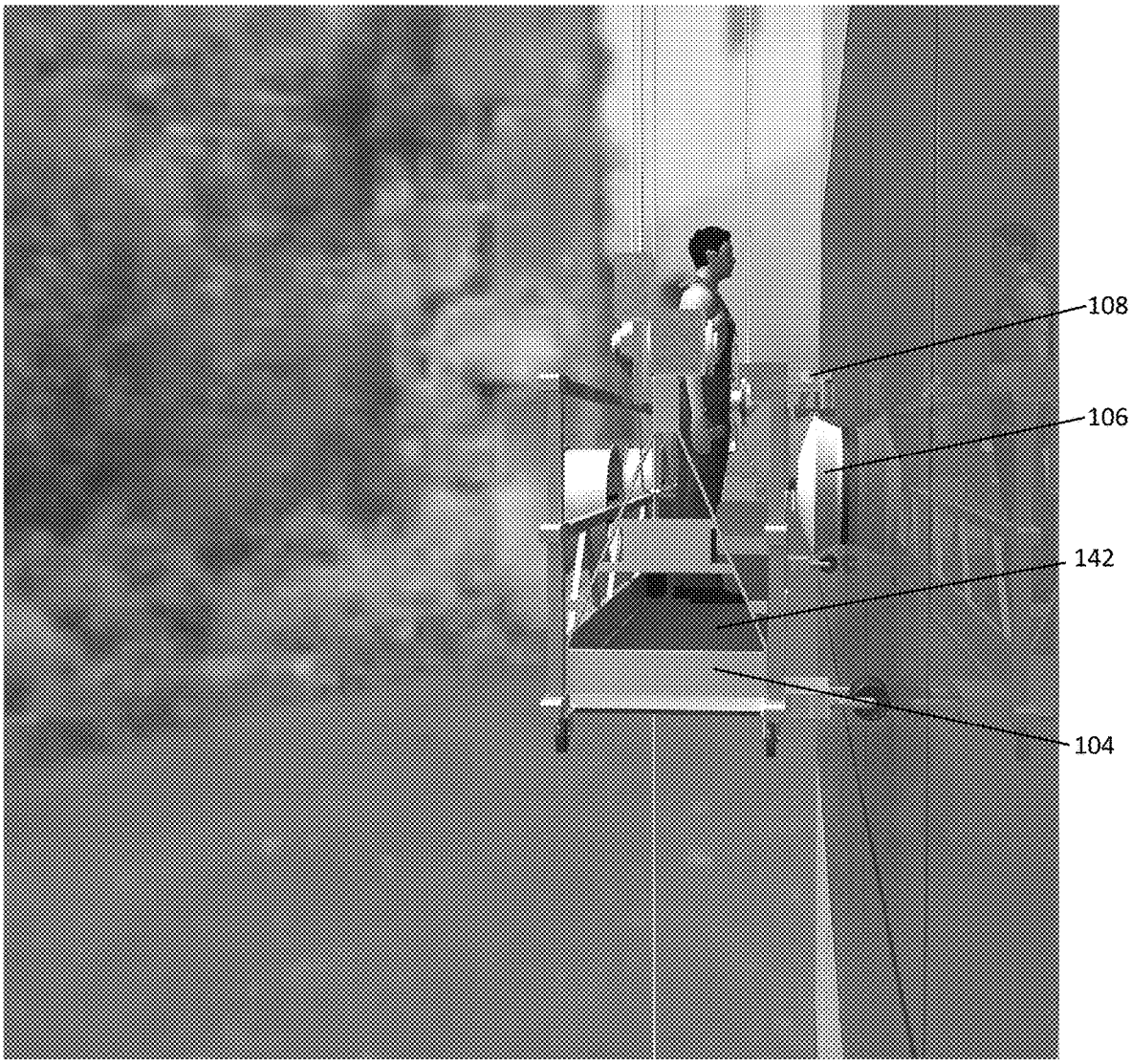
FIG. 6 is a side view of an automated building cleaning device shown against an exterior surface of a building in accordance with certain example embodiments.
Figure 7:
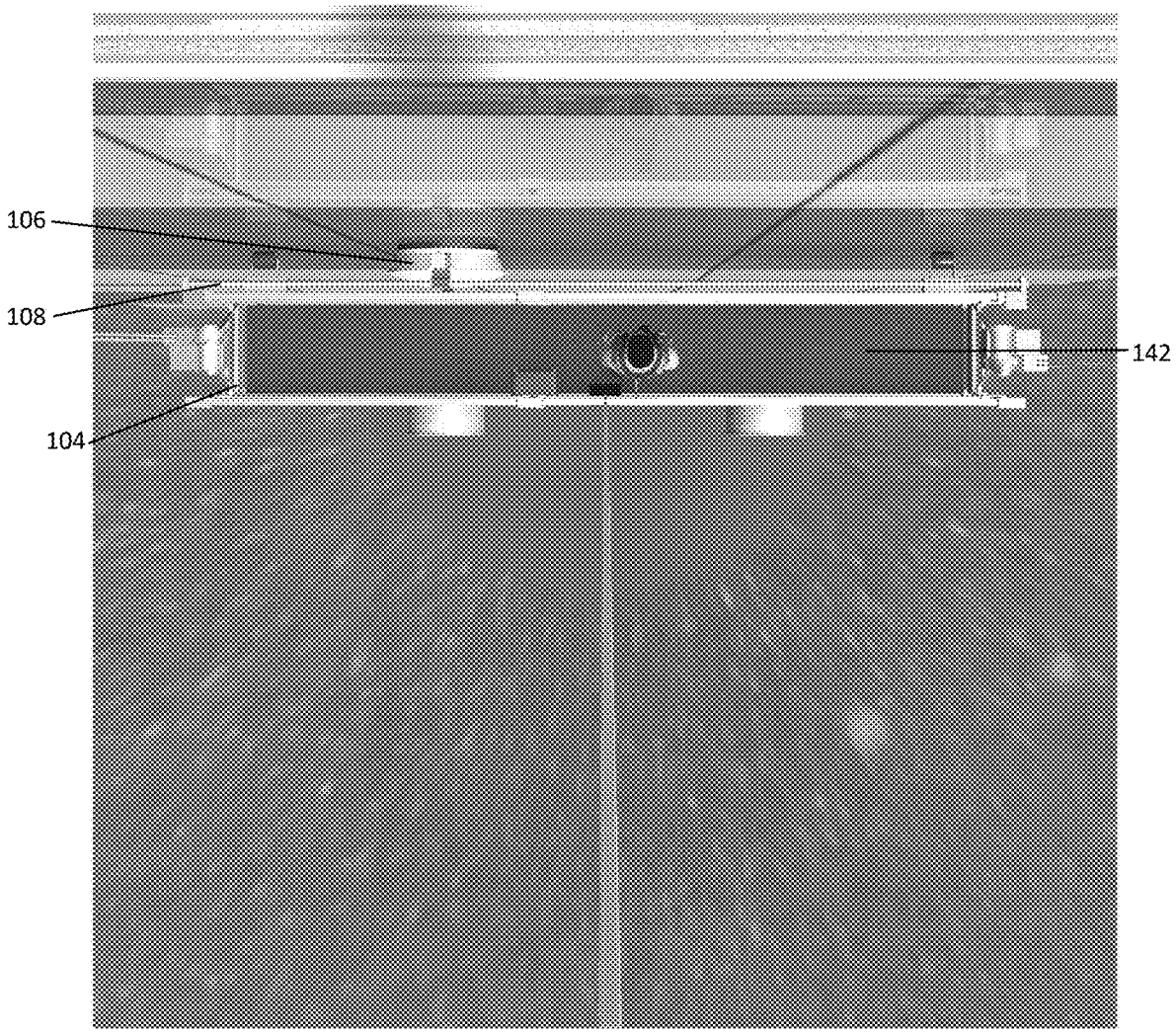
FIG. 7 is a top view of an automated building cleaning device shown against an exterior surface of a building in accordance with certain example embodiments.

As shown in FIG. 2, an outer perimeter of the shroud 112 surrounding the open side facing the building surface can be provided with a flexible gasket 113. The gasket 113 can be rubber or similar flexible material that deforms if impacted by protruding features on the building's surface. Thus, the spray bar assembly 106 can more more easily across the building's surface without incurring damage. An air-filled bladder can also be used in place of the gasket in further alternative embodiments.

The cleaning water or solution is plumbed via a conduit to the back side of the shroud 112 to supply the bar 110 with the cleaning water/solution under pressure. The rotational joint that couples the bar 110 to the inside of the shroud 112 is configured to impart rotational movement as the pressurized water flows through the joint and toward the spray heads 114 or nozzles. The spray heads 114 can additionally or alternatively be angled to generate/enhance rotational movement of the bar 110 as the water is sprayed onto the building surface. An electric motor can also be provided to the spray bar assembly 106 and coupled to the hollow bar 110 to drive the rotation of the bar 110.

A fluid collection area and drain can be provided at the vertical bottom of the shroud 154 to collect and drain spattered liquid and debris caught by the shroud.

A valve provided to the water supply line can vary the input pressure to the spray bar assembly 106, and therefore the rotational speed and aggressiveness of the cleaning can be adjusted as desired by the user.

The shroud 112 is slidably mounted to horizontal track members 108 so that spray bar assembly 106 can slide horizontally from side-to-side (longitudinal end-to-end) of the swing stage while maintaining the orientation with respect to the building being cleaned. The longitudinal sliding movement is imparted in one embodiment via a motor 118 driving a belt coupled to the swing stage 104. A top rail 120 of the swing stage 104 can also be toothed so that a pinion mounted on an output shaft of the motor 118 can allow the motor to walk the spray bar assembly 106 horizontally along the top rail 120.

The shroud or the track can be mounted on a biased member or members that push the shroud towards the building's surface. The biased member can be a spring, motor actuated gear, or a piston actuated by hydraulics or pneumatics.

Figure 8:
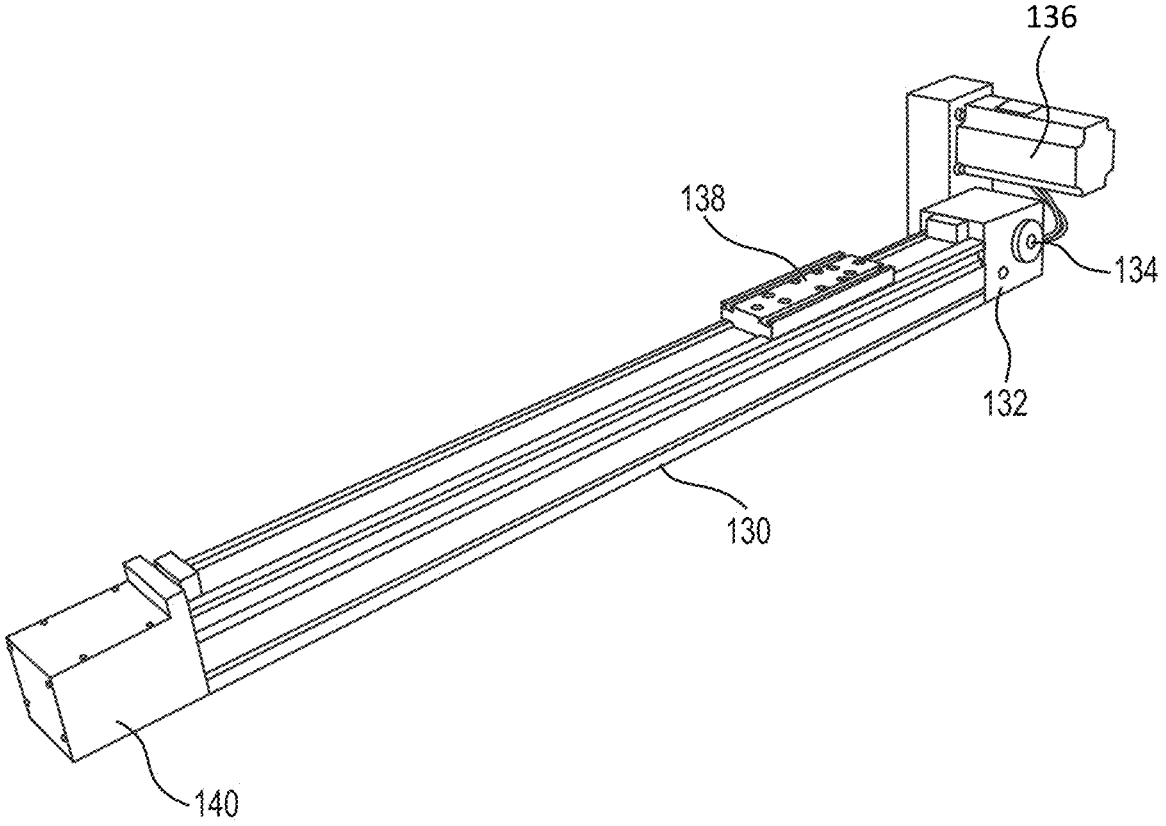
FIG. 8 is a perspective view of a rodless belt-drive actuator in accordance with certain example embodiments.

In another alternative, the rodless belt-driven actuator mechanism 130 shown in FIG. 8 can be used. This mechanism 130 uses a belt that wraps around an internal drive pulley on a drive end 132. The belt is connected to a drive shaft 134 that is connected to a shaft of a drive motor 136 to move a fitting 138 longitudinally along the longitudinal length of the actuator mechanism 130. On the opposite end (take-up end) from the drive end 132 is a pulley end 140 that houses a pulley to support the belt 132. The shroud 112 is coupled to the fitting 138 by a bracket so that there is a controlled linear movement of the spray bar assembly 106 as the drive motor 136 moves the fitting 138.

Other sliding movement mechanisms can be provided in alternative embodiments. For example, an alternative sliding movement mechanism can be a rack and pinion electric actuator. A screw drive can also be used. Alternatively, the horizontal movement can be provided via gear drives or chain drives attached to swing stage 104, or via hydraulic actuators or pneumatic actuators.

Thrusters, such as fans 122 are mounted to the swing stage 104 on the long side thereof opposite the building. The thrusters or fans 122 act as a counterforce means to push the swing stage (and thus the spray bar assembly 106) towards the building. The fans 122 can be variable speed so that the force pushing the spray bar assembly 106 towards the building is adjusted as needed to maintain a constant pressure or positioning of the spray bar assembly 106 against the building surface.

Sensors can be provided to the swing stage 104 such as along a vertical members, to measure the force on shroud 112 pushing against the building. The fan's speed (or the other counterforce means) can be automatically adjusted by a microcontroller coupled to the fan's drive motor and the sensor as needed to maintain a preset force minimum value and/or stay below a preset force maximum value.

Alternatively, or in addition to the fans, other means to keep the swing stage retained to the building (counterforce means) can be provided. For example, wheels or fittings protruding from the swing stage can travel in tracks defined on the surface of the building. Counterweights and stabilizing cables can also be provided. Other alternatives include use of suction cups that releasably grab onto the building surface.

A control box 116 is coupled to the swing stage 104. The control box 116 contains the control electronics for operating the motors to rotate and move the spray bar assembly 106, as well as to operate the counterforce means such as the fans. The suspension cable motors 129 can also be controlled by the control electronics in the control box 116.

The control electronics disposed inside of the control box 116 can include a microprocessor that executes software code stored in a non-transitory memory. The control electronics can also be located remotely, such as on the building rooftop and a wired or wireless connection is formed with the components on the swing stage 104.

A remote control can also be provided to allow a user to remotely-operate the washing apparatus 100. The remote control allows an operator to manually control functions of the washing apparatus 100. The remote control can also be used to initiate and terminate automated washing routines. An antenna can be coupled to, or integrated into, the control electronics to receive commands from the remote control.

A stabilization cable 124 can be secured to the rooftop such as on the rigging for the swing stage 104. The stabilization cable 124 is coupled to a block stop 126 that is attached to the swing stage 104. This configuration aids in preventing the swing stage 104 from moving away from the building during a cleaning operation.

Suspension cables 128 for the swing stage 104 can be fastened to cable motors 129 disposed at the longitudinal ends of the swing stage 124.

Power for the motors, pump and/or and onboard electronics can be provided by onboard batteries and/or via a power cable extending down or up the building to the control box 116. A battery can be disposed in the control box or elsewhere on the swing stage 104.

In a further alternative embodiment, there can be two spray bar assemblies 106 operating in the same sweep plane of the horizontal track members 108. In such embodiment, the spray bar assemblies 106 can move in opposing directions and cover a respective half of the horizontal track width, with a slight overlap in the middle of the track. Alternatively, both spray bar assemblies 106 can be disposed adjacent to one another and move together with a constant horizontal spacing maintained between the respective shrouds 112.

In a further alternative, the shroud 112 can be enlarged (e.g, elliptical) so that two rotating bars 110 can be enclosed within the shroud.

The track 108 and spray bar assembly 106 and control electronics can be retrofit to existing swing stages.

The rotation direction of the spray bar assembly 106 can be varied and even reversed as desired. The control electronics can also vary the input power (or fluid line pressure) to dynamically to maintain a pre-set rotation speed. The control electronics can also employ an algorithm that increases or decreases rotation speed proportionate to the longitudinal slide speed increase or decrease.

A water containment baffle can also be provided to the swing stage to catch water or cleaning solution that falls from the brushes and drips from the building. The baffle can direct the water or solution that is caught by the baffle to an onboard holding tank that the user can periodically empty.

The water supply for cleaning can be supplied by the building being cleaned, such as a water supply line coupled to an outside water tap or spigot of the building. Alternatively, the water can be brought to the site in a storage tank. The storage tank can be onboard the swing stage 104 or remotely-located and coupled to the cleaning device 100.

The water can be converted to a cleaning solution by running it through a deionizing and reverse osmosis (DI/RO) water filter which takes most minerals out of the water. The DI/RO cleaning water can be held in a tank onboard the swing stage 104 or a supply hose can be run to the swing stage 104 from a remote location.

The DI water is sufficient to adequately clean the building and windows. Thus the cleaning process described herein is very environmentally friendly. However, chemicals or environmentally safe chemicals can be injected into the machine, if desired.

In a further aspect, the water ionization and filtering apparatus can be mounted onboard the cleaning machine 100. This allows the machine 100 to be simply connected to a tap water source and a separate ionizing and filter apparatus need not be provided.

In an additional aspect of the invention, one or more stabilizer gyros can be disposed on the swing stage 104 to provide for an additional or alternative means to reduce any desire of the swing stage to bounce or move away from contact with the building surface when in operation. Suitable stabilizer gyros such as the KS-4, KS-10 or KS-12 units are available from Kenyon Laboratories LLC, but other models and brands of gyro stabilizer can be used without departing from the scope of the invention. The stabilizer gyro can be mounted to the swing stage 104 with the axis of rotation aligned in a vertical direction. Thus, the stabilizer gyro(s) will resist any sudden motion of the swing stage 104 away from the building. The gyro(s) effectively operate as dampers on the frequency and amplitude of forces that would cause the cleaning machine 100 to move away from the building surface being cleaned. The rotational axis of the gyros can be adjusted to maximize this stabilizing effect.

In use, the swing stage 104, with the automated cleaning apparatus components and electronics disposed thereon, is lowered into position along an exterior surface of the building. The hollow bar 110 of the spray bar assembly 106 rotates while the spray bar assembly 106 slides horizontally from side-to-side along the longitudinal length of the track 108 on swing stage 104. Cleaning water and/or cleaning chemicals are applied as desired. The thrusters, such as fans 122, are run to keep the brushes in contact with the building's surface. Stabilizing cables and/or gyros can also be used for the same purpose.

Once a section of the building is cleaned the swing stage is moved downward to the next section. Cleaning can also be performed by moving upward from a lower portion of the building. Once a vertical section of the building is cleaned, the swing stage is repositioned horizontally to a new vertical section of the building, which is then cleaned with the machine 100 as described herein. The process is repeated until the building is cleaned.

Alternatively, the cleaning apparatus 100 can be continuously moved downward/upward at a fixed speed as the building is being cleaned. The lateral sliding speed of the spray bar assembly 106 is set fast enough such that at least some part of one of the brushes contacts all portions of the building in the vertical cleaning section.

More than one automated cleaning apparatus 100 can be used to clean a single building.

The automated cleaning apparatus can be retrofitted to exiting swing stage installations. The swing stage can still be used in a conventional manner however. The automated cleaning apparatus can also be mounted to other apparatus such as an articulating boom (e.g. of a boom truck), vertical mast lifts, scissor lifts and other types of booms and lifts.

One or more persons can occupy the swing stage while it is operating, or the swing stage can be operated autonomously without an operator present. The spray bar assembly 106 and drive components can be easily accessed by operators during operation.

The automated cleaning apparatus 100 can be remotely operated so that no persons need be present on the swing stage. In these unmanned embodiments, the automated cleaning apparatus 100 is also operated remotely.

One or more cameras can be mounted to the automated cleaning apparatus or to the swing stage so that remote operation can be monitored by the operator or by others that are located in a remote location. The cameras can also be used to confirm that the building was correctly cleaned.

The horizontal track members 108 can extend (or be adjusted to extend) longitudinally beyond the opposing longitudinal ends of the swing stage to increase the horizontal cleaning sweep area.

The sweep area can be adjusted or limited as needed by limiting the horizontal travel of the spray bar assembly 106 to only a certain range along the track members 108.

The swing stage can define a deck 142 that is sized to allow an adult human to walk between opposing longitudinal ends of the swing stage.

While the invention has been described in connection with what is presently considered to be the most practical and preferred embodiments, it will be apparent to those of ordinary skill in the art that the invention is not to be limited to the disclosed embodiments. It will be readily apparent to those of ordinary skill in the art that many modifications and equivalent arrangements can be made thereof without departing from the spirit and scope of the present disclosure, such scope to be accorded the broadest interpretation of the appended claims so as to encompass all equivalent structures and products. Moreover, features or aspects of various example embodiments may be mixed and matched (even if such combination is not explicitly described herein) without departing from the scope of the invention.

What is claimed is:

1. An automated building washing apparatus, comprising:

a swing stage;

a track coupled to the swing stage, the track movable in a horizontal axis along the swing stage parallel to a surface to be washed; and a spray bar assembly coupled to the track such that the spray bar assembly can move along the horizontal axis across the surface to be washed, the spray bar assembly comprising, a circular shroud defining an enclosure with an open side that faces the surface to be washed;

a hollow bar rotationally disposed about its midpoint inside of the circular shroud, wherein the hollow bar rotates about an axis that is perpendicular to a direction that the track moves;

a first spray head disposed at a first end of the hollow bar; and a second spray head disposed at a second end of the hollow bar, wherein the first and second spray heads are configured to spray a cleaning solution or water towards the surface to be washed.

2. The automated building washing apparatus of claim 1, wherein the first and second spray heads are recessed within the shroud such that they do not protrude outward from the open side and contact the surface to be washed.

3. The automated building washing apparatus of claim 1, further comprising a control box disposed on the swing stage, the control box comprising control electronics for controlling operation of the track.

4. The automated building washing apparatus of claim 3, wherein the control electronics are configured to increase a speed that the track moves the spray bar assembly when a speed that the swing stage is ascending or descending the surface to be washed is increased.

5. The automated building washing apparatus of claim 1, further comprising a control box disposed on the swing stage, the control box comprising control electronics for controlling a rotational speed of the hollow bar, wherein the control electronics are configured to increase a rotational speed of the hollow bar when a speed that the swing stage is ascending or descending the surface to be washed is increased.

6. The automated building washing apparatus of claim 1, wherein the swing stage comprises a first longitudinal side to face a building surface to be cleaned and a second longitudinal side, opposite the first longitudinal side, that faces away from the building surface to be cleaned, the automated building washing apparatus further comprising a counterforce means to move or hold the spray bar assembly adjacent to the surface to be washed.

7. The automated building washing apparatus of claim 6, wherein the counterforce means is a fan.

8. The automated building washing apparatus of claim 1, wherein the shroud is located between the swing stage and the surface to be washed.

9. The automated building washing apparatus of claim 1, wherein the swing stage defines a deck that is sized to allow an adult human to walk between opposing longitudinal ends of the swing stage, and wherein the spray bar assembly is located such that the spray bar assembly does not impede the adult human from walking between opposing longitudinal ends of the swing stage when the spray bar assembly is moved along the track.

10. The automated building washing apparatus of claim 1, further comprising a gyroscopic stabilizer provided to the swing stage.

11. The automated building washing apparatus of claim 1, further comprising a block stop provided to the swing stage and configured to be secured to a stabilization cable.

12. An automated building washing assembly that can be retrofitted to a swing stage, the automated building washing assembly comprising:

a track that can be coupled to the swing stage; and a spray bar assembly coupled to the track such that the spray bar assembly can move horizontally between opposing longitudinal ends of the track, the spray bar assembly comprising, a circular shroud defining an enclosure with an open side that faces outward from the swing stage and towards a surface to be washed;

a hollow bar rotationally disposed about its midpoint inside of the circular shroud, wherein the hollow bar rotates about an axis that is perpendicular to a direction that the spray bar assembly moves along the track;

a first spray head disposed at a first end of the hollow bar; and a second spray head disposed at a second end of the hollow bar, wherein the first and second spray heads are configured to spray a cleaning solution or water towards the surface to be washed.

13. The automated building washing apparatus of claim 12, wherein the first and second spray heads are recessed within the shroud such that they do not protrude outward from the open side and contact the surface to be washed.

14. The automated building washing apparatus of claim 12, further comprising a control box disposed on the swing stage, the control box comprising control electronics for controlling operation of the track.

15. The automated building washing apparatus of claim 14, wherein the control electronics are configured to increase a speed that the track moves the spray bar assembly when a speed that the swing stage is ascending or descending the surface to be washed is increased.

16. The automated building washing apparatus of claim 12, further comprising a control box disposed on the swing stage, the control box comprising control electronics for controlling a rotational speed of the hollow bar, wherein the control electronics are configured to increase a rotational speed of the hollow bar when a speed that the swing stage is ascending or descending the surface to be washed is increased.

17. The automated building washing apparatus of claim 12, wherein the swing stage comprises a first longitudinal side to face a building surface to be cleaned and a second longitudinal side, opposite the first longitudinal side, that faces away from the building surface to be cleaned, the automated building washing apparatus further comprising a counterforce means to move or hold the spray bar assembly adjacent to the surface to be washed.

18. The automated building washing apparatus of claim 12, wherein the shroud is located between the swing stage and the surface to be washed.

19. The automated building washing apparatus of claim 12, wherein the swing stage defines a deck that is sized to allow an adult human to walk between opposing longitudinal ends of the swing stage, and wherein the spray bar assembly is located such that the spray bar assembly does not impede the adult human from walking between opposing longitudinal ends of the swing stage when the spray bar assembly is moved along the track.

* * * * *